US009164421B2

(12) United States Patent
Hayashi et al.

(10) Patent No.: US 9,164,421 B2
(45) Date of Patent: Oct. 20, 2015

(54) TONER BOTTLE, SUPPLY UNIT, AND IMAGE FORMING APPARATUS

(71) Applicant: KONICA MINOLTA, INC., Tokyo (JP)

(72) Inventors: Hideji Hayashi, Okazaki (JP); Kengo Asai, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 13/842,748

(22) Filed: Mar. 15, 2013

(65) Prior Publication Data

US 2013/0259533 A1 Oct. 3, 2013

(30) Foreign Application Priority Data

Apr. 2, 2012 (JP) ..... 2012-083813

(51) Int. Cl.
*G03G 15/08* (2006.01)

(52) U.S. Cl.
CPC ..... *G03G 15/0834* (2013.01); *G03G 15/0868* (2013.01); *G03G 15/0872* (2013.01); *G03G 15/0886* (2013.01)

(58) Field of Classification Search
CPC ..... G03G 15/0877; G03G 15/0867; G03G 15/0868; G03G 15/087; G03G 15/0872
USPC ..... 399/119, 120, 252–258, 260, 262
See application file for complete search history.

(56) References Cited

U.S. PATENT DOCUMENTS

2006/0182469 A1* 8/2006 Koyama et al. ..... 399/258
2007/0092302 A1 4/2007 Koyama
2009/0092415 A1* 4/2009 Murakami et al. ..... 399/119
2011/0280630 A1* 11/2011 Itabashi ..... 399/260
2012/0114386 A1* 5/2012 Takashima ..... 399/258

FOREIGN PATENT DOCUMENTS

JP 2006323082 11/2006
JP 2007102133 4/2007

OTHER PUBLICATIONS

Chinese Office Action (and English translation thereof) dated Apr. 3, 2015, issued in counterpart Chinese Application No. 201310109861.9.

* cited by examiner

*Primary Examiner* — Walter L Lindsay, Jr.
*Assistant Examiner* — Jessica L Eley
(74) *Attorney, Agent, or Firm* — Holtz, Holtz, Goodman & Chick PC

(57) ABSTRACT

A first shutter covers a first supply port formed in an outer peripheral surface of a main body, and can move in an outer peripheral direction along the outer peripheral surface of the main body. A pair of guiding members respectively formed on both ends of the first shutter guide the first shutter in the outer peripheral direction. A lock mechanism fixes the first shutter to achieve a closed state of the first supply port. The lock mechanism includes a protrusion provided to the first shutter, the protrusion being capable of engaging with a recess formed in the outer peripheral surface. Fixing by the lock mechanism is released when the protrusion elastically deforms and is disengaged from the recess. The protrusion, the recess, and the first supply port are disposed along a virtual curve between the pair of guiding members.

12 Claims, 10 Drawing Sheets

TONER BOTTLE, SUPPLY UNIT, AND IMAGE FORMING APPARATUS

CROSS-REFERENCE TO RELATED APPLICATIONS

The present application claims priority under 35 U.S.C. §119 to Japanese Patent Application No. 2012-083813, filed Apr. 2, 2012. The contents of this application are incorporated herein by reference in their entirety.

BACKGROUND OF THE INVENTION

1. Field of the Invention

The present invention relates to a toner bottle, a supply unit, and an image forming apparatus.

2. Discussion of the Background

A technique of sealing toner in a toner supply container by covering an opening with a container shutter has conventionally been known (for example, Japanese Unexamined Patent Application Publication No. 2006-323082 and Japanese Unexamined Patent Application Publication No. 2007-102133).

Furthermore, a technique of locking the container shutter with engaging portions attached to guiding members also has conventionally been known (for example, Japanese Unexamined Patent Application Publication No. 2006-323082). Still furthermore, a shutter member that moves along a rotational axis of a toner bottle also has conventionally been known (Japanese Unexamined Patent Application Publication No. 2007-102133).

In the toner supply container of Japanese Unexamined Patent Application Publication No. 2006-323082, the guiding members are provided on both ends of the container shutter, which moves in an outer peripheral direction of the toner supply container. As described above, the engaging portion that locks the container shutter is attached to each of the guiding members. Thus, both ends of the container shutter are locked by the engaging portions.

As a result, depending on variation of sizes of the guiding members, the engaging portions, and the container shutter at the time of formation, opening and closing operation of the container shutter might not be able to be carried out stably.

SUMMARY OF THE INVENTION

An object of the present invention is to provide a toner bottle, a supply unit, and an image forming apparatus that can favorably supply toner.

An embodiment of the present invention for solving the problem described above is a toner bottle capable of storing toner in a main body, including: a first shutter configured to cover a first supply port formed in an outer peripheral surface of the main body, the first shutter being movable in an outer peripheral direction along the outer peripheral surface of the main body; a pair of guiding members respectively formed on both ends of the first shutter, and configured to guide the first shutter in the outer peripheral direction; and a lock mechanism configured to fix the first shutter to achieve a closed state of the first supply port. The lock mechanism includes a protrusion provided to the first shutter, the protrusion being capable of engaging with a recess formed in the outer peripheral surface. Fixing by the lock mechanism is released when the protrusion elastically deforms and is disengaged from the recess. The protrusion, the recess, and the first supply port are disposed along a virtual curve between the pair of guiding members.

Another embodiment of the present invention is a supply unit configured to supply toner to a developing unit, including: the toner bottle; and a sub-hopper configured to temporarily store the toner supplied from the toner bottle, and supply the toner to the developing unit. The sub-hopper includes: a supporter configured to support the toner bottle; a storage unit configured to store the toner supplied from the toner bottle supported by the supporter through a second supply port; and a second shutter configured to cover the second supply port formed in the storage unit. As the toner bottle supported by the supporter rotationally moves relative to the sub-hopper, the first and the second supply ports transition to an opened state, and a supply path for the toner through the first and the second supply ports is formed.

A still another embodiment of the present invention is an image forming apparatus including: the supply unit; an image carrier; and the developing unit configured to develop an electrostatic latent image on the image carrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
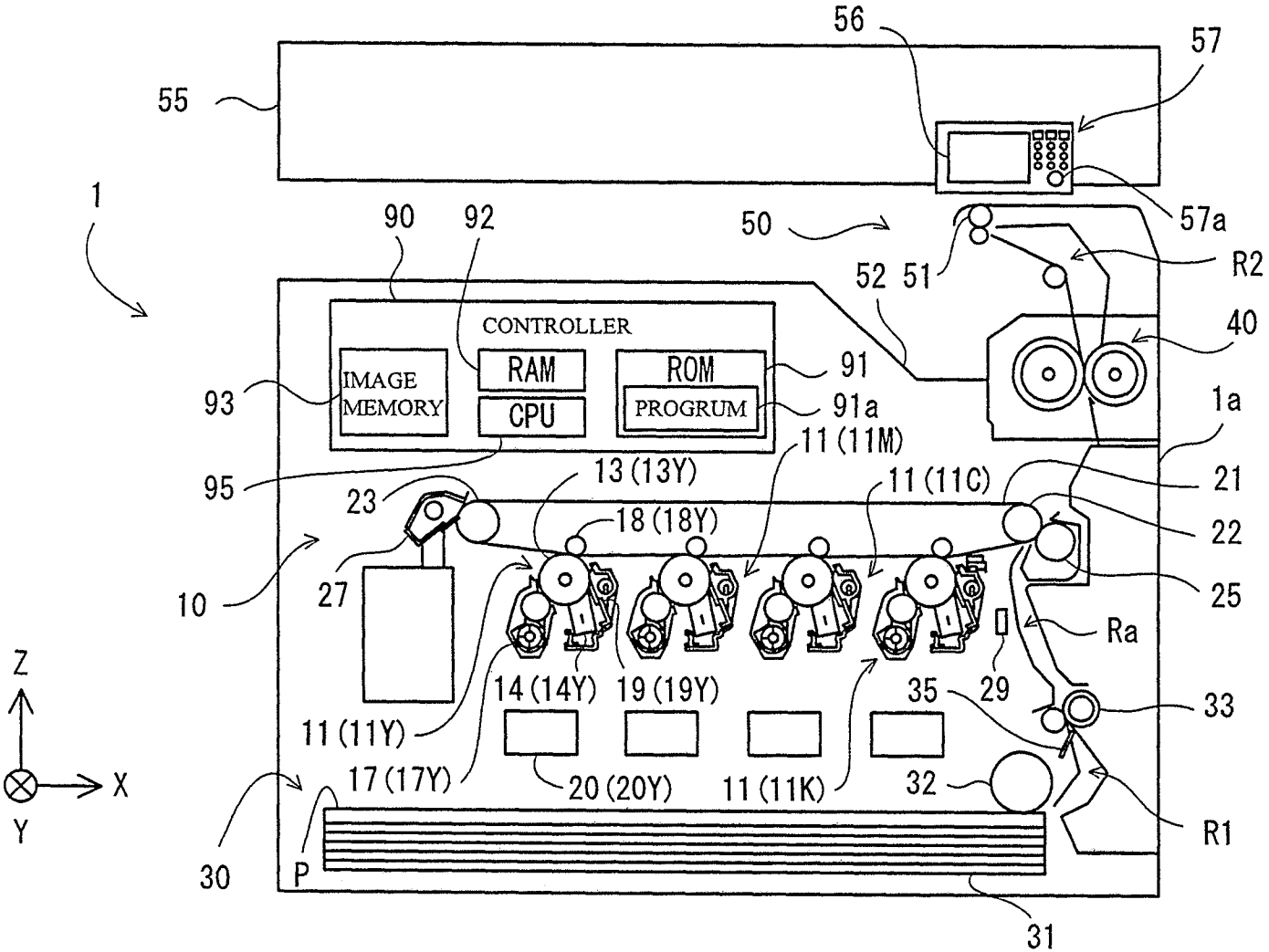
FIG. 1 is a front view showing an overall configuration of an image forming apparatus according to an embodiment of the present invention.

The embodiments will now be described with reference to the accompanying drawings, wherein like reference numerals designate corresponding or identical elements throughout the various drawings.

1. Configuration of Image Forming Apparatus

FIG. 1 is a front view showing an overall configuration of an image forming apparatus 1 according to an embodiment of the present invention. The image forming apparatus 1 is used as, for example, a multi-function machine integrally incorporating copy, printing, and fax capabilities, and prints a monochrome image or a color image by electrophotography.

As shown in FIG. 1, the image forming apparatus 1 mainly includes a printer unit 10, a sheet feeder 30, a fixing unit 40, a discharge unit 50, a scanner 55, a display unit 56, and a controller 90. FIG. 1 and the drawings thereafter are provided, as appropriate, with an XYZ orthogonal coordinate system in which a Z axis direction is a vertical direction and an XY plane is a horizontal surface, to clarify the directional relationship in the drawings.

The printer unit 10 prints a monochrome or color image on a recording medium P supplied through a sheet feed path R1 and a conveyance path Ra. As shown in FIG. 1, the printer unit 10 mainly includes image forming units 11 (11Y, 11M, 11C, and 11K), exposure scanners 20 (20Y, 20M, 20C and 20K), and an intermediate transfer belt 21.

The plurality of (4 in the embodiment) image forming units 11 respectively correspond to colors of yellow (Y), magenta (M), cyan (C), and black (K). As shown in FIG. 1, each of the image forming units 11 (11Y, 11M, 11C, and 11K) mainly includes a photoreceptor drum 13 (13Y, 13M, 13C, and 13K), a charger 14 (14Y, 14M, 14C, and 14K), a developing unit 17 (17Y, 17M, 17C, and 17K), a primary transfer roller 18 (18Y, 18M, 18C, and 18K), a drum cleaner 19 (19Y, 19M, 19C, and 19K), and the exposure scanner 20 (20Y, 20M, 20C and 20K).

The printer unit 10 of the embodiment is of a so-called tandem type, and along the intermediate transfer belt 21, the image forming units 11 (11Y, 11M, 11C, and 11K) are arranged in the order of yellow (Y), magenta (M), cyan (C), and black (K) from the left side to the right side of FIG. 1.

In the embodiment, the image forming units 11Y, 11M, 11C, and 11K have the same hardware configuration. Thus, the image forming unit 11Y, and the photoreceptor drum 13Y, the charger 14Y, the developing unit 17Y, the primary transfer roller 18Y, the drum cleaner 19Y, and the exposure scanner 20Y as the components of the image forming unit 11Y are described in detail below.

For the convenience of illustration, the reference numerals of the photoreceptor drums 13M, 13C, and 13K, the chargers 14M, 14C, and 14K, the developing units 17M, 17C, and 17K, the primary transfer rollers 18M, 18C, and 18K, the drum cleaners 19M, 19C, and 19K, and the exposure scanners 20M, 20C, and 20K are omitted in FIG. 1 and the drawings thereafter.

In the embodiment, the image forming units 11Y to 11K, the photoreceptor drums 13Y to 13K, the chargers 14Y to 14K, the developing units 17Y to 17K, the primary rollers 18Y to 18K, the drum cleaners 19Y to 19K, and the exposure scanners 20Y to 20K are collectively referred to as respectively the image forming unit 11, the photoreceptor drum 13, the charger 14, the developing unit 17, the primary roller 18, the drum cleaner 19, and the exposure scanner 20 in some cases.

The photoreceptor drum 13Y (image carrier) has a cylindrical or column shape, and faces the primary transfer roller 18Y with the intermediate transfer belt 21 interposed therebetween. The photoreceptor drum 13Y includes a photoconductive film on an outer peripheral surface.

The outer peripheral surface of the photoreceptor drum 13Y is irradiated with light from the corresponding exposure scanner 20Y so that charges in the irradiated area are removed. Thus, a yellow (Y) electrostatic latent image is formed on the outer peripheral surface of the photoreceptor drum 13Y. Similarly, magenta, cyan, and black electrostatic latent images are respectively formed on the outer peripheral surfaces of the photoreceptor drums 13M, 13C, and 13K.

The charger 14Y comes in contact with, and thus charges the outer peripheral surface of the photoreceptor drum 13Y. The developing unit 17Y supplies yellow (Y) toner to the photoreceptor drum 13Y on which the electrostatic latent image is formed, and thus develops the electrostatic latent image on the photoreceptor drum 13Y.

As shown in FIG. 1, the primary transfer roller 18Y faces the photoreceptor drum 13Y with the intermediate transfer belt 21 interposed therebetween. The primary transfer roller 18Y is charged with a polarity that is opposite to that of the outer peripheral surface of the photoreceptor drum 13Y. Thus, when the intermediate transfer belt 21 is nipped by the rolling photoreceptor drum 13Y and the rolling primary transfer roller 18Y, the yellow (Y) toner image is transferred onto the intermediate transfer belt 21.

The drum cleaner 19Y removes remaining toner on the outer peripheral surface of the photoreceptor drum 13Y after the toner image is transferred on the intermediate transfer belt 21 and until the next yellow toner is supplied from the developing unit 17Y. As shown in FIG. 1, the drum cleaner 19Y is positioned to be capable of contacting the outer peripheral surface of the photoreceptor drum 13Y.

The exposure scanner 20Y is so-called an exposing unit and irradiates the corresponding photoreceptor drum 13Y with a laser beam. Thus, the electrostatic latent image is formed on the outer peripheral surface of the corresponding photoreceptor drum 13Y.

The intermediate transfer belt 21 transfers the toner images of the four colors primary transferred by the image forming units 11 (11Y, 11M, 11C, and 11K), onto the recording medium P. As shown in FIG. 1, the intermediate transfer belt 21 is wound across a driving roller 22 and a driven roller 23 that rotate in the counterclockwise direction of FIG. 1. A secondary transfer roller 25 faces the driving roller 22 with the conveyance path Ra interposed therebetween and contacts the outer peripheral surface of the intermediate transfer belt 21.

Thus, by adjusting the feed timing of the intermediate transfer belt 21 and the conveyance timing of the recording medium P conveyed along the conveyance path Ra, the toner images of the four colors formed on the outer periphery of the intermediate transfer belt 21 are secondary transferred onto the recording medium P.

A developer supplied from the developing unit 17 of each image forming unit 11 is preferably a developer of one-component system using no carrier, but may be a developer of two-component system including toner and carrier. The material of the intermediate transfer belt 21 may be polycarbonate, polyimide, polyamidimide, and the like.

A temperature-humidity sensor 29 detects a temperature and/or humidity around the printer unit 10. The voltage applied to the primary transfer rollers 18 (18Y, 18M, 18C, and 18K) and a secondary transfer roller 25 is adjusted on the basis of the temperature and the humidity detected by the temperature-humidity sensor 29.

The primary and secondary transfer rollers 18 and 25 are so-called elastic rollers that are formed by adding ion conductive materials to synthetic rubber such as nitrile rubber and foaming the resultant object.

The sheet feeder 30 feeds the recording medium P to the printer unit 10. As shown in FIG. 1, the sheet feeder 30 mainly includes a sheet feed cassette 31 and a sheet feed roller 32.

The sheet feed cassette 31 is a container that can accommodate a plurality of recording media P. The sheet feed roller 32 picks up the recording media P accommodated in the sheet feed cassette 31 from the uppermost sheet, and supplies the picked-up recording medium P to the sheet feed path R1.

A pair of resist rollers 33 control the timing at which to feed the recording medium P to the conveyance path Ra. If the "direction of conveying the recording medium P" is defined as the "conveyance direction", the pair of resist rollers 33 are disposed more on the downstream side than the sheet feed roller 32 in the conveyance direction as shown in FIG. 1.

A sheet detection sensor 35 is a detector that detects the forward end of the recording medium P. As shown in FIG. 1 the sheet detection sensor 35 is disposed more on the downstream side than the pair of resist rollers 33 in the conveyance direction. When the forward end of the recording medium P reaches the sheet detection sensor 35, the output from the sheet detection sensor 35 transitions to an ON state from an OFF state for example. Thus, by monitoring the output value outputted from the sheet detection sensor 35, whether the recording medium P is supplied to a portion right before the pair of resist rollers 33 can be determined.

The fixing unit 40 applies pressure and heat to the recording medium P and thus fixes the toner images transferred on the recording medium P. As shown in FIG. 1 the fixing unit 40 is disposed more on the downstream side than the secondary transfer roller 25 in the conveyance direction.

The discharge unit 50 is disposed more on the downstream side than the fixing unit 40 in the conveyance direction, and discharges the recording medium P on which the toner image is fixed to the outside of the apparatus. Specifically, the recording medium P supplied to the discharge unit 50 through the conveyance path Ra is guided to a discharge path R2. As shown in FIG. 1, the discharge unit 50 mainly includes a pair of discharge rollers 51 disposed on the discharge path R2 and a discharge tray 52.

The scanner 55 is of an automatic document feeder (ADF) type or a flat bed type and reads an image on a document. As shown in FIG. 1, the scanner 55 is disposed above the discharge unit 50.

The display unit 56 is formed of a liquid crystal display for example, and has a "touch panel" function of allowing a position in a screen to be pointed by touching the screen with a finger or a dedicated pen. Accordingly, the user of the image forming apparatus 1 (hereinafter, simply referred as "user") gives instruction by using the "touch panel" function of the display unit 56 based on the content displayed on the display unit 56 and thus can make the image forming apparatus 1 execute certain processing (such as processing of printing the toner image on the recording medium P supplied from the sheet feeder 30). As described above, the display unit 56 can be used as a reception unit that receives an input operation from the user.

An operation unit 57 is an input unit including a plurality of key pads. For example, when a print start button 57*a* in the operation unit 57 is pressed, the printing processing on the recording medium P is executed. Thus, like the display unit 56, the operation unit 57 can be used as the reception unit that receives the input operation from the user.

The controller 90 controls the components of the image forming apparatus 1 and executes data calculation. As shown in FIG. 1, the controller 90 mainly includes a read only memory (ROM) 91, a random access memory (RAM) 92, an image memory 93, and a central processing unit (CPU) 95.

The ROM 91 is a so-called non-volatile storage unit, and stores a program 91*a* for example. The RAM 92 and the image memory 93 are each a volatile storage unit. The RAM 92 stores data used for the calculation of the CPU 95 for example. The image memory 93 stores image data pieces respectively corresponding to the colors of yellow (Y), magenta (M), cyan (C), and black (K). A flash memory that is a readable and writable non-volatile memory may be used as the ROM 91, the RAM 92, and the image memory 93.

The CPU 95 executes a control, various data calculations, and the like in accordance with the program 91*a* in the ROM 91. For example, the CPU 95 receives an image signal from an unillustrated external terminal and the like, converts the image signal into digitalized image data for Y to K colors, and controls the operations of the printer unit 10, the sheet feeder 30, and the like. Thus, the printing processing on the recording medium P is executed.

2. Configuration of Supply Unit

Figure 2:
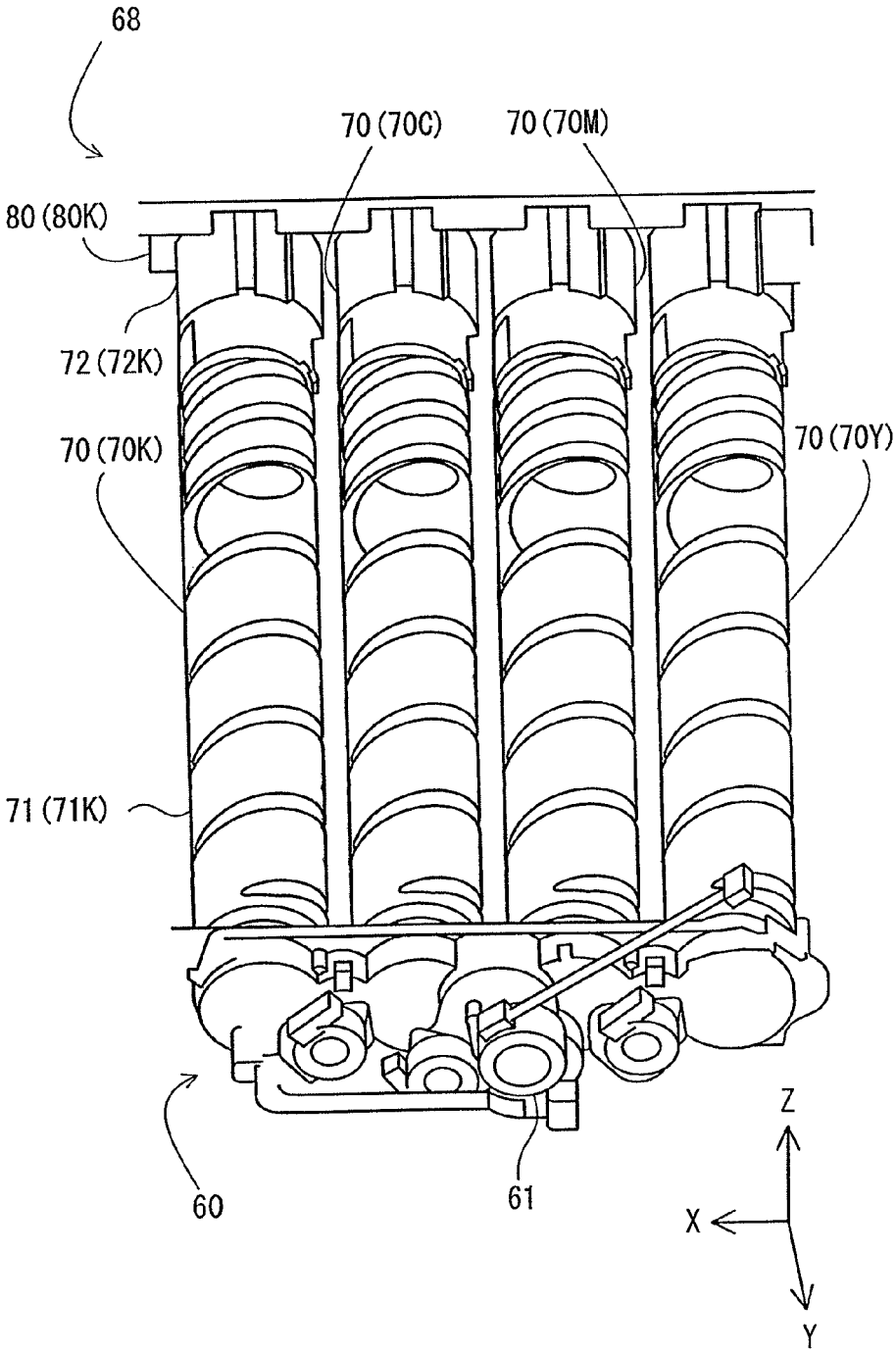
FIG. 2 is a rear perspective view showing a configuration of a supply unit according to an embodiment of the present invention.
Figure 3:
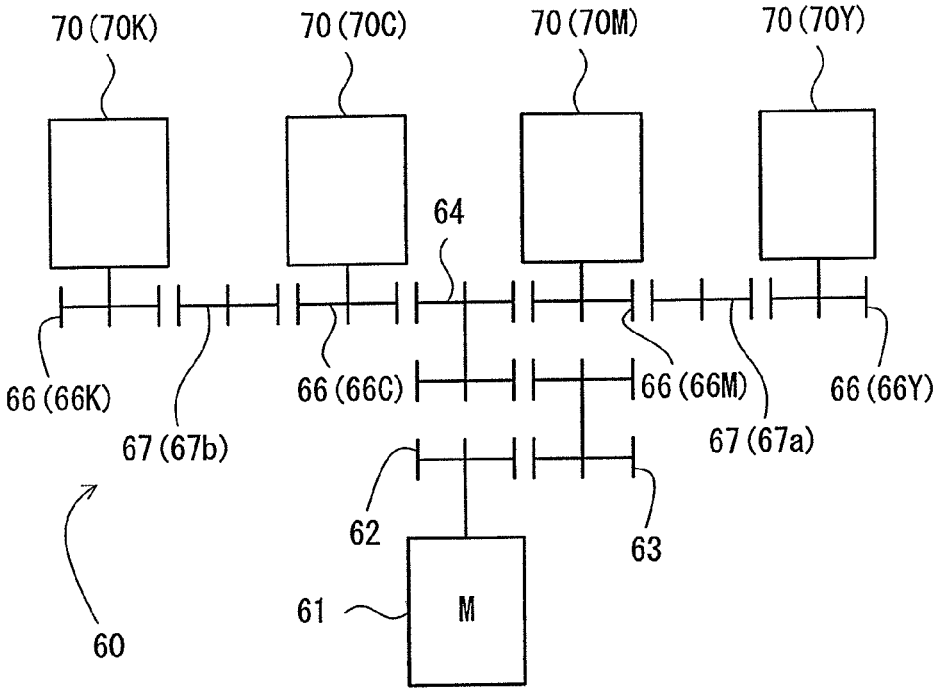
FIG. 3 is a skeleton diagram of a power transmission system in a toner bottle drive unit according to an embodiment of the present invention.
Figure 4:
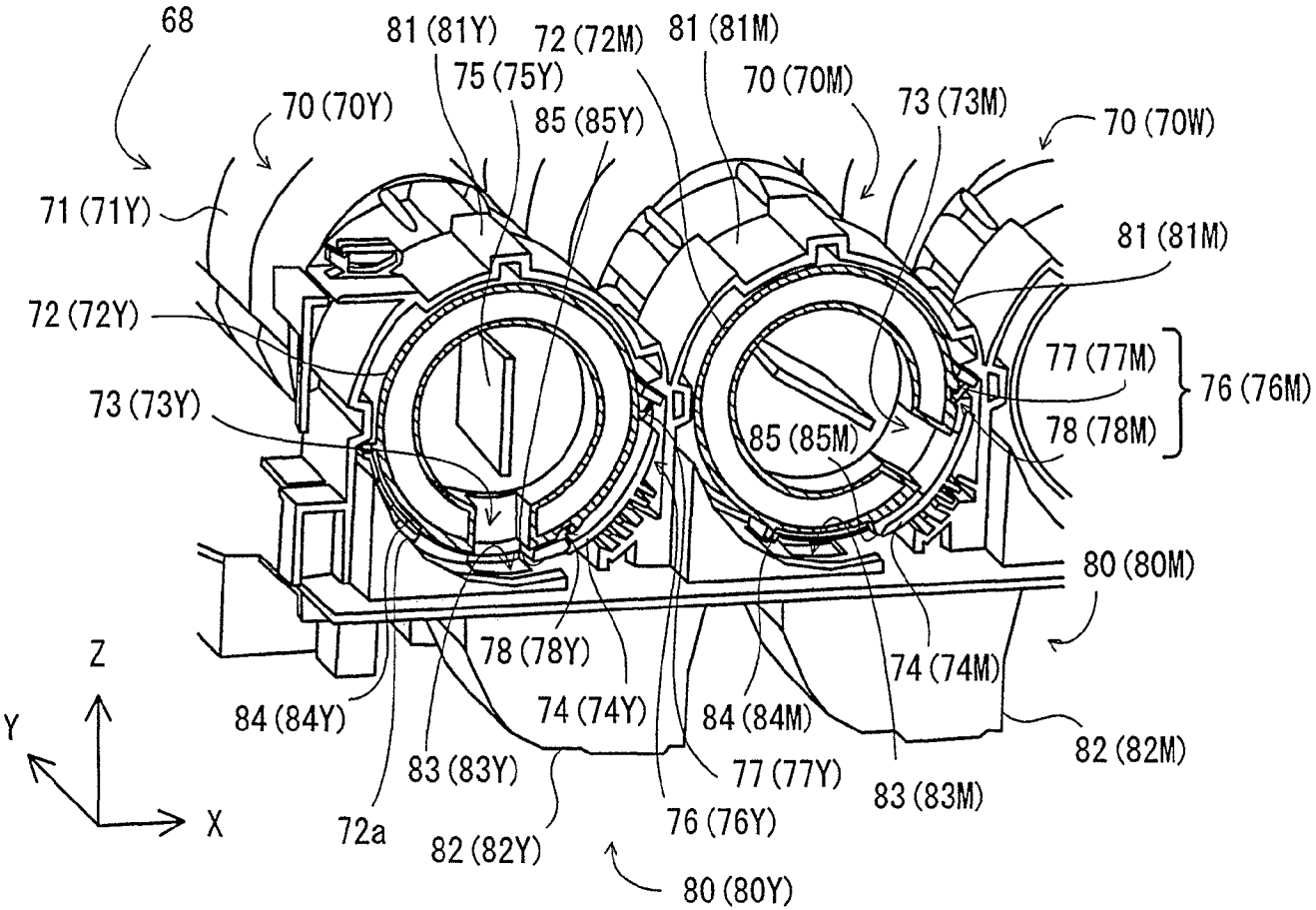
FIG. 4 is a front perspective view showing configuration of a toner bottle and a sub-hopper according to an embodiment of the present invention.

FIG. 2 is a rear perspective view showing a configuration of a supply unit 68 according to an embodiment of the present invention. FIG. 3 is a skeleton diagram of a power transmission system in a toner bottle drive unit 60 according to an embodiment of the present invention. The supply unit 68 supplies yellow (Y) toner, magenta (M) toner, cyan (C) toner, and black (K) toner respectively to the developing units 17 (17Y, 17M, 17C, and 17K). As shown in FIG. 2 and FIG. 4, the supply unit 68 mainly includes the toner bottle drive unit 60, a plurality of toner bottles 70 (70Y, 70M, 70C, and 70K), and a plurality of sub-hoppers 80 (80Y, 80M, 80C, and 80K).

The toner bottle drive unit 60 rotates the toner bottles 70 (70Y, 70M, 70C, and 70K). The toner bottle drive unit 60 is disposed on the rear side of the image forming apparatus 1, and mainly includes one motor 61 (single drive source), a plurality of gears 62, 66 (66Y, 66M, 66C, and 66K), and 67 (67*a* and 67*b*), and first and second reduction gears 63 and 64, as shown in FIG. 2 and FIG. 3.

The drive gear 62 is attached to the axial core of the motor 61 as shown in FIG. 3. The docking gears 66 (66Y, 66M, 66C, and 66K) are respectively attached to the axial cores of the toner bottles 70 (70Y, 70M, 70C, and 70K). The idler gear 67*a* is interlocked with and coupled to the docking gears 66Y and 66M, while the idler gear 67*b* is interlocked with and coupled to the docking gears 66C and 66K.

As shown in FIG. 3, the first reduction gear 63 has input and output sides respectively interlocked with and coupled to the drive gear 62 and an input side of the second reduction gear 64. The second reduction gear 64 has an output side interlocked and coupled to the docking gears 66M and 66C.

Thus, when the motor 61 is rotated and the driving force supplied from the motor 61 is provided to the toner bottles 70 (70Y, 70M, 70C, and 70K) through the drive gear 62, the first and second reduction gears 63 and 64, the docking gears 66 (66Y, 66M, 66C, and 66K), and the idler gears 67 (67*a* and 67*b*), the toner bottles 70 (70Y, 70M, 70C, and 70K) are rotated in the same direction.

As described above, power transmission elements such as a mechanical clutch is not used in the toner bottle drive unit 60. Thus, the starting torque, stopping torque, and rated torque of the motor 61 can be reduced. Thus, the manufacturing cost of the image forming apparatus 1 as a whole can be reduced.

Each of the plurality of (four in the embodiment) toner bottles 70 (70Y, 70M, 70C, and 70K) is rotated by the toner bottle drive unit 60, and thus conveys toner in a direction from the front side to the rear side of the image forming apparatus 1 (hereinafter, also simply referred to as "toner supply direction"). The configuration of the toner bottles 70 (70Y, 70M, 70C and 70K) will be described in detail later.

The plurality of (four in the embodiment) sub-hoppers 80 (80Y, 80M, 80C, and 80K) temporarily store the toner supplied from the respective toner bottles 70 (70Y, 70M, 70C and 70K), and supply the toner to the respective developing units 17 (17Y, 17M, 17C, and 17K). The configuration of the sub-hoppers 80 (80Y, 80M, 80C, and 80K) will be described in detail later.

3. Configuration of Toner Bottle and Sub-Hopper

Figure 5:
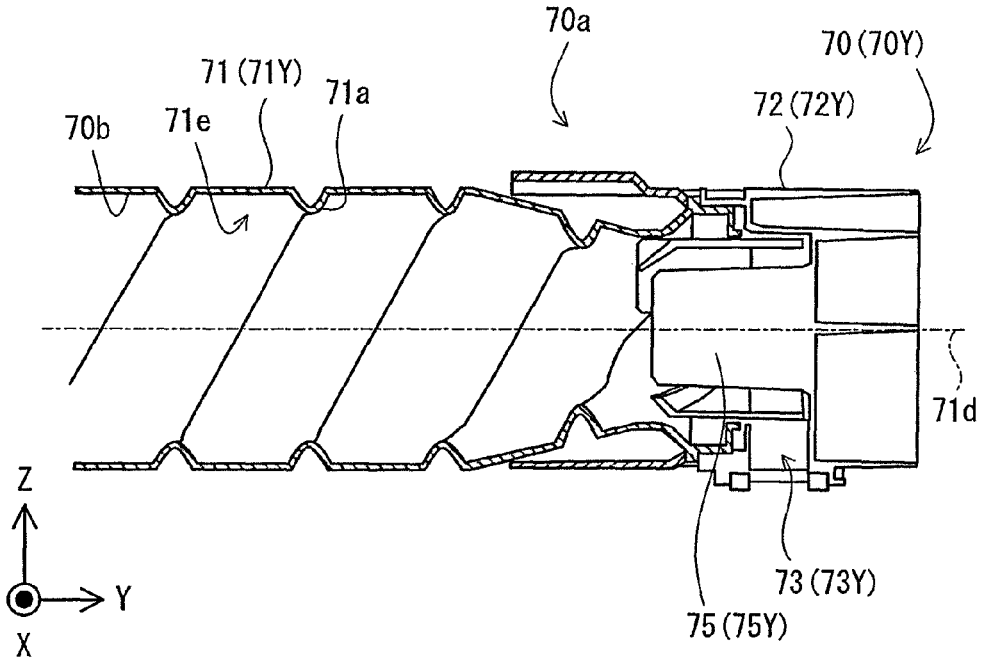
FIG. 5 is a side cross-sectional view showing a configuration of the toner bottle according to an embodiment of the present invention.
Figure 6:
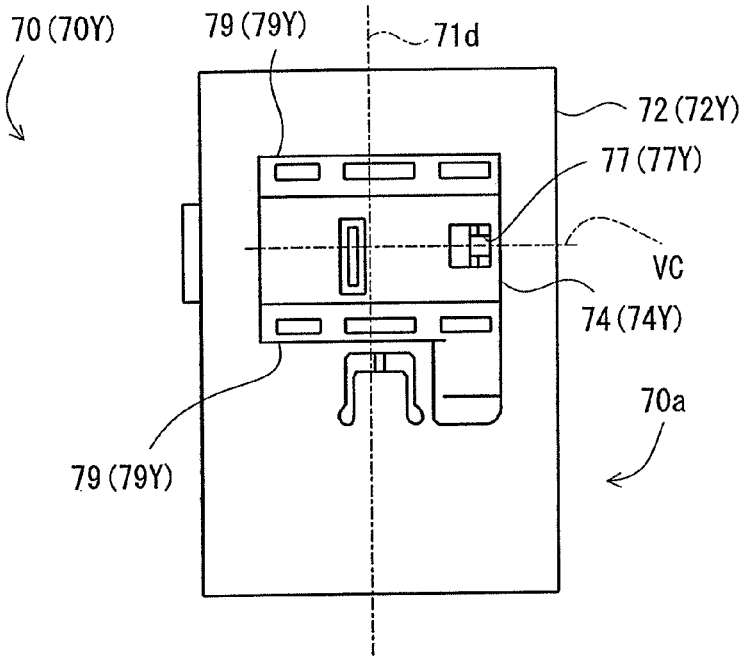
FIG. 6 is a diagram showing a configuration of a shutter of the toner bottle according to an embodiment of the present invention.
Figure 7:
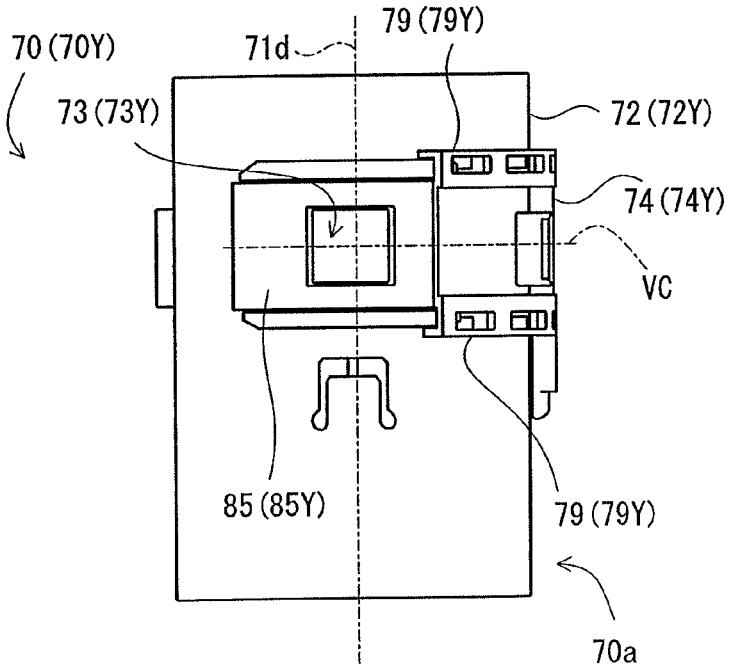
FIG. 7 is a diagram showing a configuration of the shutter of the toner bottle according to an embodiment of the present invention.
Figure 8:
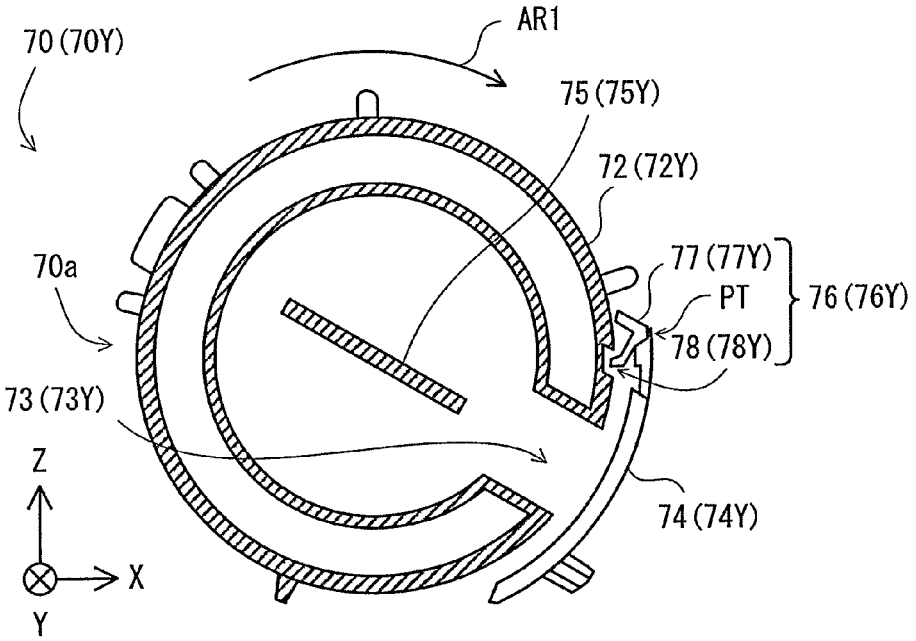
FIG. 8 is a front view showing a configuration of the toner bottle according to an embodiment of the present invention.
Figure 9:
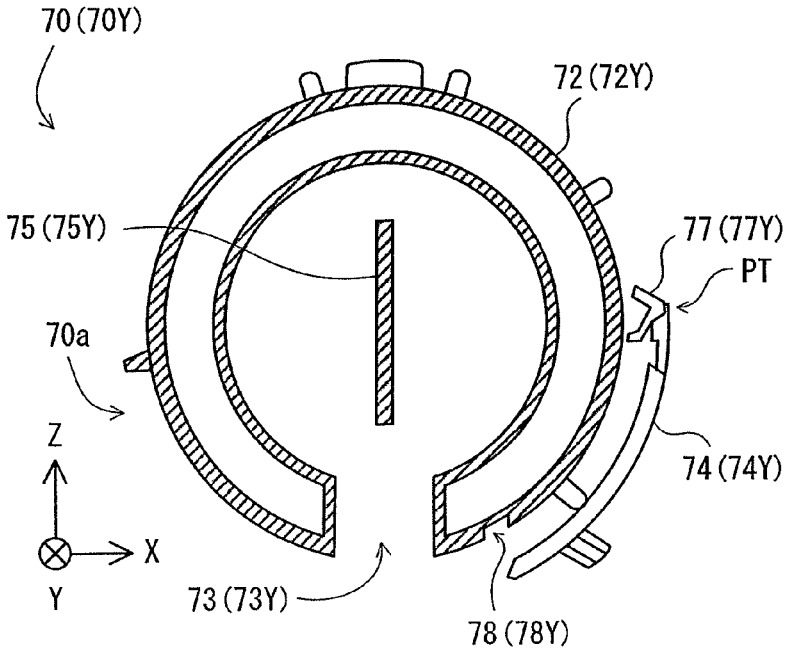
FIG. 9 is a front view showing a configuration of the toner bottle according to an embodiment of the present invention.
Figure 10:
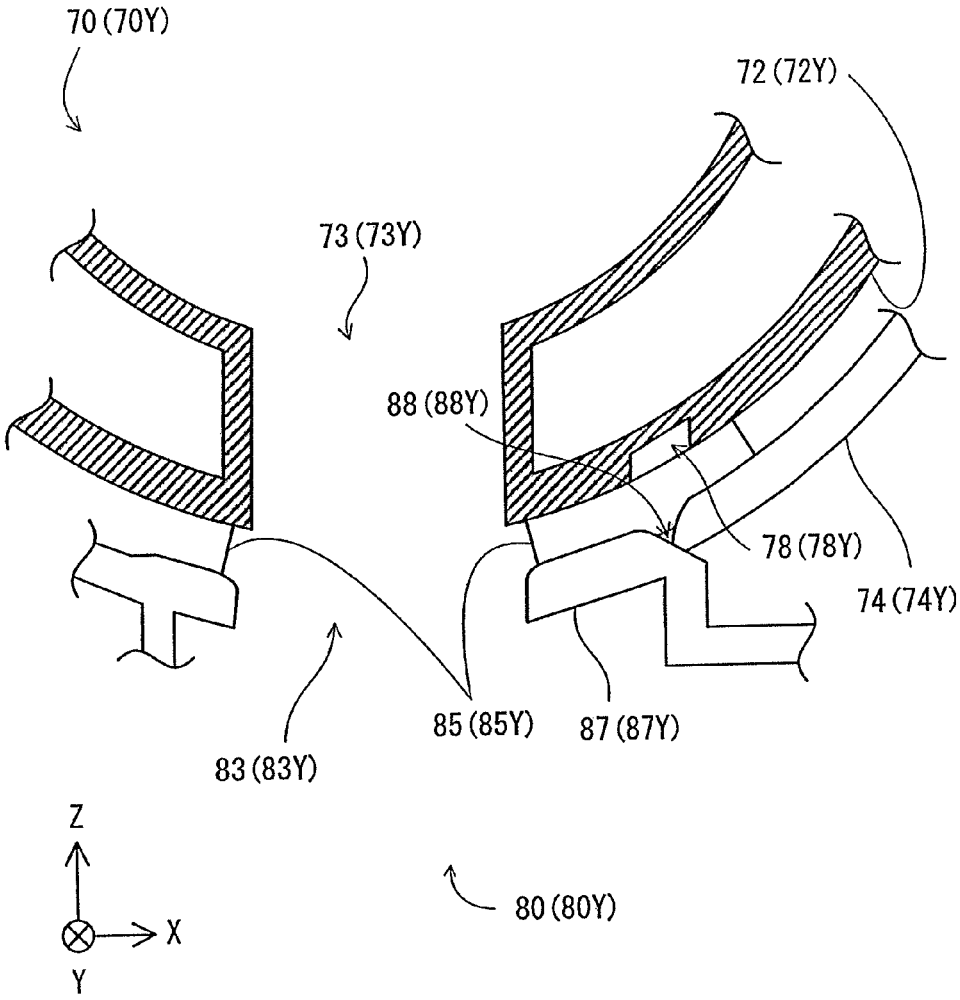
FIG. 10 is a front view showing a configuration of a seal unit according to an embodiment of the present invention.
Figure 11:
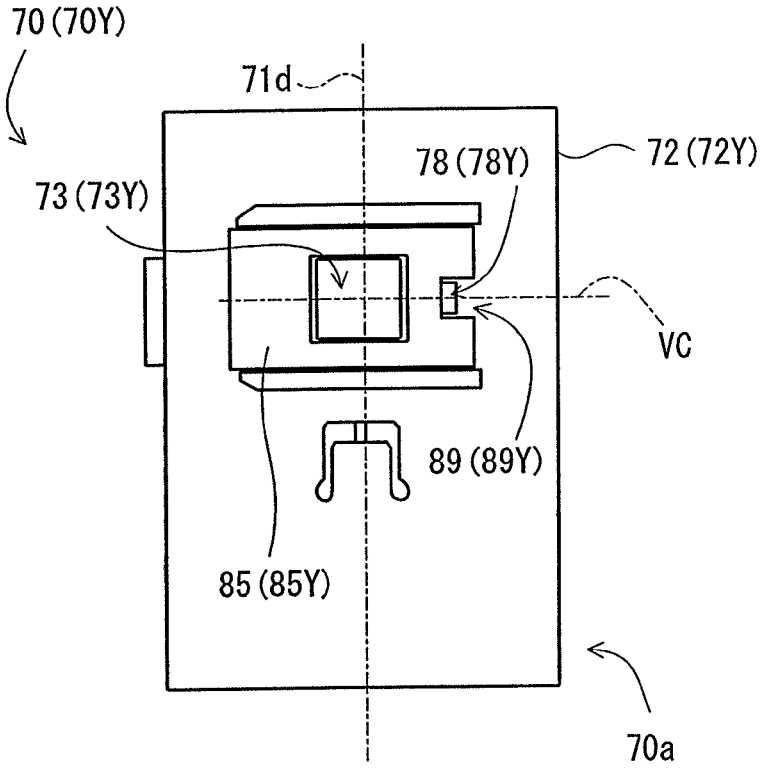
FIG. 11 is a diagram showing a configuration of the seal unit according to an embodiment of the present invention.
Figure 12:
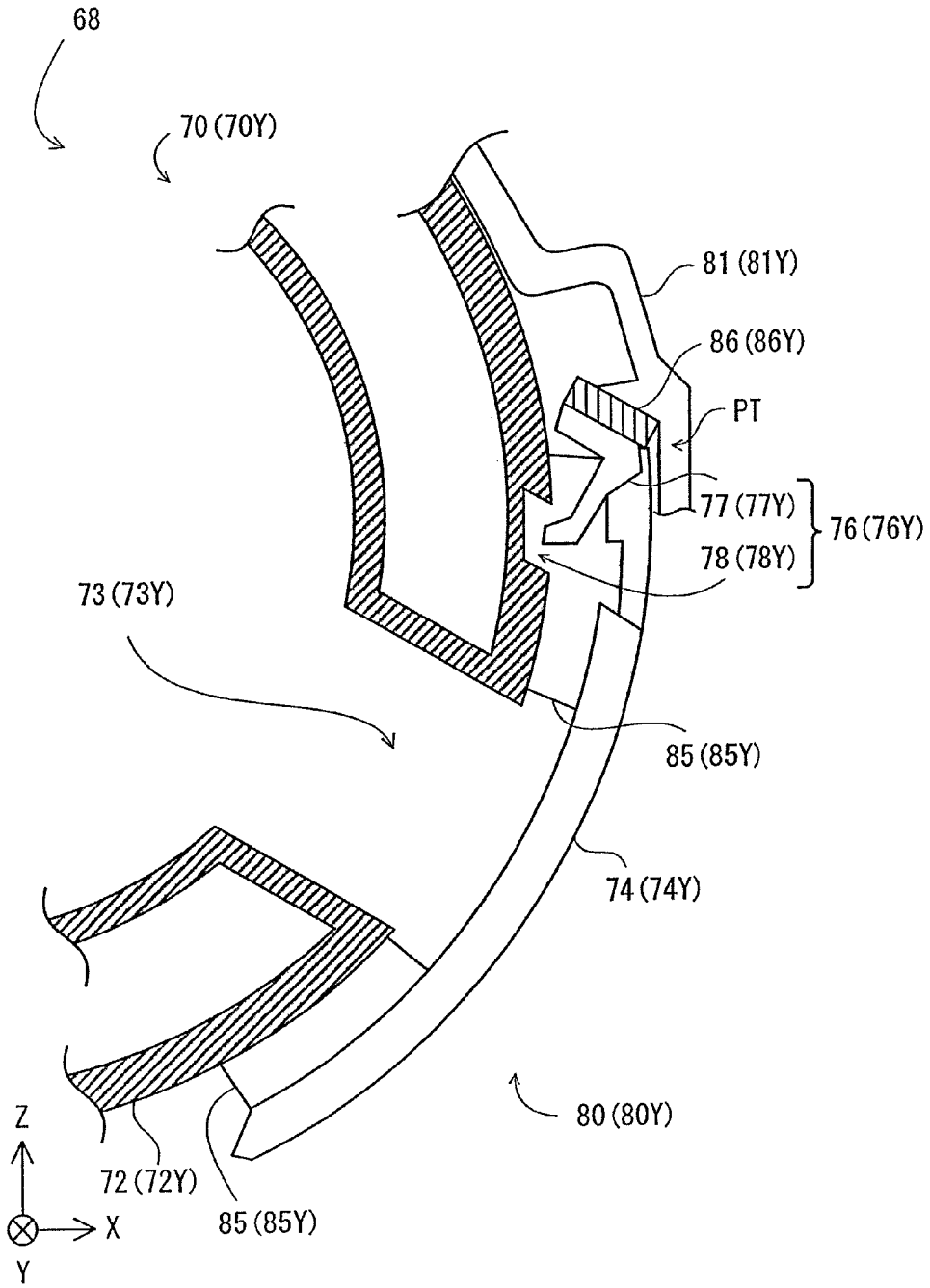
FIG. 12 is a front view showing a configuration around a lock mechanism according to an embodiment of the present invention.

FIG. 4 is a front perspective view showing a configuration of the toner bottle 70 and the sub-hopper 80 according to an embodiment of the present invention. FIG. 5 is a side cross-sectional view showing a configuration of the toner bottle 70 according to an embodiment of the present invention. FIGS. 6 and 7 are each a diagram showing a configuration of a shutter 74 according to an embodiment of the present invention. FIGS. 8 and 9 are each a front view showing a configuration of the toner bottle 70 according to an embodiment of the present invention. FIGS. 10 and 11 are each a diagram showing a configuration of a seal unit 85 according to an embodiment of the present invention. FIG. 12 is a front view showing a configuration around a lock mechanism 76 according to an embodiment of the present invention.

Here, the configuration of the toner bottles 70 (70Y, 70M, 70C, and 70K) is first described, and then the configuration of the sub-hoppers 80 (80Y, 80M, 80C, and 80K) is described.

In the embodiment, the toner bottles 70Y, 70M, 70C, and 70K store respectively the toner corresponding to the colors of yellow (Y), magenta (M), cyan (C), and black (K). The toner bottles 70Y, 70M, 70C, and 70K are only different in the type of stored toner, and have the same hardware configuration.

Thus, in the description below, the toner bottle 70Y, and a container 71Y, a cover 72Y, a supply port 73Y, a shutter 74Y, a stirrer 75Y, a lock mechanism 76Y, a pair of guiding members 79Y, and a seal unit 85Y as components of the toner bottle 70Y are mainly described.

For the convenience of illustration, the reference numerals of containers 71C and 71K, covers 72C and 72K, supply ports 73C and 73K, shutters 74C and 74K, stirrers 75C and 75K, lock mechanisms 76C and 76K, guiding members 79M, 79C, and 79K, and seal units 85C and 85K are omitted in FIG. 4 and the drawings thereafter.

In the description given below, the toner bottles 70Y to 70K, the containers 71Y to 71K, the covers 72Y to 72K, the supply ports 73Y to 73K, the shutters 74Y to 74K, the stirrers 75Y to 75K, the lock mechanisms 76Y to 76K, the guiding members 79Y to 79K, and the seal units 85Y to 85K are collectively referred to as respectively the toner bottle 70, the container 71, the cover 72, the supply port 73, the shutter 74, the stirrer 75, the lock mechanism 76, the guiding member 79, and the seal unit 85 in some cases.

The toner bottle 70Y stores the toner in a container space 71*b* of the container 71Y and on the inner side of the cover 72Y. As shown in FIG. 4 to FIG. 9, the toner bottle 70Y mainly includes the container 71Y, the cover 72Y, the shutter 74Y, the stirrer 75Y, and the lock mechanism 76Y.

In the embodiment, as shown in FIG. 5, a component including the container 71 and the cover 72 is also referred to as a main body 70*a*. Specifically, the toner bottle 70Y can store toner in the main body 70*a*.

As shown in FIG. 5, the container 71Y is rotatable with respect to the cover 72Y. As shown in FIG. 5, the container 71Y and the cover 72Y each have a cylindrical shape. The protrusion 71*a* protrudes from an inner wall 70*b* toward the container space 71*b* and is formed into a spiral shape along the toner supply direction.

Thus, as the container 71Y rotates about a rotational axis 71*d*, the toner contained in the container space 71*b* is held in a groove 71*e* defined by the neighboring protrusion 71*a* and is supplied toward the supply port 73.

The shutter 74Y (first shutter) is a lid that prevents the toner from leaking out of the toner bottle 70Y when the toner bottle 70Y is exchanged, conveyed, or subjected to the like operation. As shown in FIG. 5, the shutter 74Y covers the supply port 73Y (first supply port) formed on the outer peripheral surface of the main body 70*a*.

The length of the shutter 74Y in the outer peripheral direction (indicated by the arrow AR1 in FIG. 8) along the outer peripheral surface of the main body 70*a* is shorter than the outer peripheral length of the main body 70*a*. Thus, the shutter 74Y can prevent the toner leakage by only partially covering the main body 70*a* in the outer peripheral direction. Thus, the manufacturing cost of the shutter 74Y can be reduced.

The stirrer 75Y is a plate body disposed right above the supply port 73Y as shown in FIG. 4 and FIG. 5. As shown in FIG. 5, the stirrer 75Y is disposed along the rotational axis 71*d* of the toner bottle 70Y. The stirrer 75Y stirs the toner contained in the container space 71*b* along with the rotation of the container 71Y. Thus, even the toner staying around the supply port 73Y can be favorably stirred by the stirrer 75Y.

The pair of guiding members 79Y guide the shutter 74Y in the outer peripheral direction of the main body 70*a*. As shown in FIG. 6 and FIG. 7, the pair of guiding members 79Y extend in the outer peripheral direction of the main body 70*a* and are disposed on both ends of the shutter 74 in the extending direction of the rotational axis 71*d*.

The lock mechanism 76Y fixes the shutter 74 to achieve the closed state of the supply port 73Y. As shown in FIG. 8 and FIG. 9, the lock mechanism 76Y includes a protrusion 77Y. The locking function of the lock mechanism 76Y is implemented by the protrusion 77Y and a recess 78Y.

The protrusion 77Y can engage with the recess 78Y formed on the outer peripheral surface of the main body 70*a* (specifically the cover 72Y). As shown in FIG. 8 and FIG. 9, the protrusion 77Y is provided to the shutter 74Y in a cantilever manner and has an approximately L shape.

As shown in FIG. 8, when the shutter 74Y is fixed by the lock mechanism 76Y, a fix end of the protrusion 77Y is at an attachment position PT opposite to the supply port 73Y with respect to the recess 78Y.

When the shutter 74Y is fixed by the lock mechanism 76Y, for the supply port 73Y to transition to the opened state from the closed state, the shutter 74Y needs to move in a direction to be separated from the recess 78Y.

Here, when the shutter 74Y moves in the separating direction while the protrusion 77Y is engaged with the recess 78Y, a force in the pulling direction works on the protrusion 77Y, and the engaged state between the protrusion 77Y and the recess 78Y is maintained. Thus, while the shutter 74Y is in the fixed state, the toner leakage from the supply port 73Y can be prevented.

As shown in FIG. 10, the seal unit 85Y is disposed between the cover 72Y and the shutter 74Y. As shown in FIG. 11, the seal unit 85Y is attached on the outer peripheral surface of the main body 70*a* (more specifically the cover 72Y) in such a manner as to surround the supply port 73Y. Thus, the toner stored in the main body 70*a* can be prevented from leaking out through the supply port 73Y.

The seal unit 85Y has a notch 89Y. As shown in FIG. 11, the notch 89Y has a rectangular shape corresponding to the recess 78Y. Thus, the recess 78Y is not covered by the seal unit 85Y and is exposed through the notch 89Y.

As described above, the shutter 74Y is movable in the outer peripheral direction of the main body 70*a*. When the toner bottle 70Y rotationally moves relative to the sub-hopper 80Y while the cover 72Y of the toner bottle 70Y is supported by a supporter 81Y and the fixing of the shutter 74Y is released, friction force works between the shutter 74Y and the seal unit 85Y.

In the embodiment, to reduce the wearing of the seal unit 85 due to the friction force, the shutter 74Y has a tapered shape. Specifically, as shown in FIG. 10, if the contact portion between the stopper 87Y of the sub-hopper 80Y and the shutter 74Y is defined as a contact portion 88Y, around the contact portion 88Y, the shutter 74Y has a larger thickness at a portion farther from the contact portion 88Y in the outer peripheral direction of the cover 72Y. Thus, an end portion of the seal unit 85 can be prevented from being turned by the friction force from the shutter 74Y.

Returning to FIG. 4, the sub-hoppers 80 (80Y, 80M, 80C, and 80K) are described. In the embodiment, the sub-hoppers 80Y, 80M, 80C, and 80K are only different in the type of stored toner and have the same hard ware configuration.

Thus, the sub-hopper 80Y, and the supporter 81Y, a storage unit 82Y, the supply port 83Y, the shutter 84Y, the seal unit 85Y, and a biasing member 86Y as the components of the sub-hopper 80Y are mainly described below.

For the convenience of illustration, the reference numerals of the sub-hoppers 80C and 80K, supporters 81C and 81K, storage units 82C and 82K, supply ports 83C and 83K, shutters 84C and 84K, seal units 85C and 85K, and biasing members 86M, 86C, and 86K are omitted in FIG. 4 and the drawings thereafter.

In the description given below, the sub-hoppers 80Y to 80K, the supporters 81Y to 81K, the storage units 82Y to 82K, the supply ports 83Y to 83K, the shutters 84Y to 84K, the seal units 85Y to 85K, and the biasing members 86Y to 86K are collectively referred to as respectively the sub-hopper 80, the supporter 81, the storage unit 82, the supply port 83, the shutter 84, the seal unit 85, and the biasing member 86 in some cases.

The supporter 81Y supports the corresponding toner bottle 70Y. As shown in FIG. 4, the supporter 81Y has a tubular shape. When the toner bottle 70Y is supported, the cover 72Y of the toner bottle 70Y is inserted in the inner space of the supporter 81Y.

The storage unit 82Y temporarily stores the toner supplied from the toner bottle 70Y. As shown in FIG. 4, the supply port 83Y (second supply port) is formed in an upper portion of the storage unit 82Y. Thus, the storage unit 82Y stores the toner supplied from the toner bottle 70Y supported by the supporter 81Y through the supply port 83Y.

When the toner bottle 70Y is attached to the sub-hopper 80Y and supported by the supporter 81Y, the shutter 74Y is stopped at the stopper 87Y disposed in an upper portion of the storage unit 82.

Here, the stopper 87Y has a tapered shape at a portion around the contact portion 88Y, and around the contact portion 88Y, the stopper 87Y has a larger thickness at a portion farther from the contact portion 88Y in the outer peripheral direction of the cover 72Y. As described above, around the contact portion 88Y, the shutter 74Y has a larger thickness at a portion farther from the contact portion 88Y in an outer peripheral direction of the cover 72Y.

Thus, as shown in FIG. 10, when the supply ports 73Y and 83Y are in the opened state, the seal unit 85Y covers the contact portion 88Y between the shutter 74Y and the stopper 87Y. Thus, the toner supplied from the toner bottle 70Y can be prevented from entering a gap formed between the shutter 74Y and the stopper 87Y.

When the toner bottle 70Y rotationally moves relative to the sub-hopper 80Y, friction force works between the stopper 87Y and the seal unit 85Y. As described above, the stopper 87Y has a tapered shape at a portion around the contact portion 88Y. Thus, the end portion of the seal unit 85 can be prevented from being turned by the friction force from the stopper 87Y.

The shutters 84Y and 84M (second shutters) are lids that prevent toner leakage from the respective storage units 82Y and 82M when the toner bottles 70Y and 70M are detached from the respective supporters 81Y and 81M.

For example, as shown in FIG. 4, when the shutter 74M of the toner bottle 70M is in the closed state, the shutter 84M of the sub-hopper 80M covers the supply port 83M. In contrast, when the container 71Y of the toner bottle 70Y is rotated about the rotational axis 71*d*, and thus the shutter 74Y is opened, the shutter 84Y of the sub-hoper 80Y is also in the opened state. Thus, the main body 70*a* of the toner bottle 70Y is communicated with the storage unit 82Y of the sub-hopper 80Y through the supply ports 73Y and 83Y.

Seal members (not illustrated) are attached on closed surfaces (curved surfaces opposed to the supply ports 83Y and 83M) of the shutters 84Y and 84M. Thus, when the toner bottles 70Y and 70M are exchanged, scattering of toner from the storage units 82Y and 82M resulting in contamination inside the main body 1*a* of the image forming apparatus 1 by the toner can be effectively prevented.

Furthermore, when the supply ports 73Y and 73M are in the opened state, the shutters 84Y and 84M are biased in directions to respectively close the supply ports 73Y and 73M. Thus, when the toner bottles 70Y and 70M are respectively detached from the sub-hoppers 80Y and 80M, the supply ports 83Y and 83M are promptly closed.

Here, the toner is supplied from the toner bottle 70Y to the sub-hopper 80Y through the following procedure. Specifically, when the amount of the toner stored in the storage unit 82Y is determined to be smaller than a threshold value, the toner bottle drive unit 60 makes the container 71Y rotate about the rotational axis 71*d*. Thus, the toner stored in the main body 70*a* of the toner bottle 70Y is supplied to the storage unit 82Y of the sub-hopper 80Y through the supply ports 73Y and 83Y.

As shown in FIG. 12, the biasing member 86Y is a rectangular elastic body secured to the supporter 81Y. The biasing member 86Y biases the protrusion 77Y toward the cover 72Y. Thus, when the toner bottle 70Y is attached to the sub-hopper 80Y, the biasing force from the biasing member 86Y brings the shutter 74Y into contact with the stopper 87Y without leaving a space therebetween. Thus, the toner leakage is prevented.

4. Toner Bottle Exchange

Here, the exchange procedure for the toner bottle 70 is described with reference to FIG. 4. In the embodiment, the user detaches the used toner bottle 70 attached to the sub-hopper 80 and attaches the new toner bottle 70.

When the toner in the main body 70*a* of the toner bottle 70 is used up, the controller 90 displays the message indicating that the toner bottle 70 should be exchanged on the display unit 56. Thus, through the notification of the message, the user can recognize the timing to exchange the toner bottle 70.

The detachment procedure can be implemented by executing the process of the attachment procedure in the reverse order. Thus, only the attachment procedure for the new toner bottle 70 is described below, and the operation of detaching the used toner bottle 70 is not described below.

In the attachment procedure of the toner bottle 70, first, the cover 72 of the toner bottle 70 is inserted in the supporter 81 of the sub-hopper 80. Next, while the cover 72 is inserted in the storage unit 82, the container 71 is manually rotated about the rotational axis 71*d*. Thus, the protrusion 77 elastically deforms and is disengaged from the recess 78, and thus the fixing by the lock mechanism 76 is released. Thus, the cover 72 moves relative to the shutter 74 of the toner bottle 70 in the outer peripheral direction, and the shutter 74 is opened.

The manual rotation brings a contacting portion 72*a* of the cover 72 into contact with the shutter 84, thereby moving the shutter 84 in the outer peripheral direction. Thus, the supply port 83 of the storage unit 82 is opened.

As described above, as the toner bottle 70 supported by the supporter 81 rotationally moves relative to the sub-hopper 80, the supply ports 73 and 83 transition to the opened state, and the supply path of toner through the supply ports 73 and 83 is formed. Thus, the toner can be supplied from the toner bottle 70 to the sub-hopper 80.

In a case where the shutter 74 of the toner bottle 70 and the shutter 84 of the sub-hopper 80 are opened through the manual rotation of the toner bottle 70, the operation force amount applied to the shutters 74 and 84 needs to be reduced for example, for the opening and closing operation of the shutters 74 and 84 to be stably performed. In the embodiment, to reduce the operation force amount, at least the supply port 73, the protrusion 77, and the recess 78 are disposed along a virtual curve VC.

Here, if the protrusion 77, the recess 78, and the pair of guiding members 79 are formed of a single member, the opening and closing operation of the shutters 74 and 84 might be unstable (for example, not be performed smoothly) depending on the variation in the size of the single member at the time of forming.

Therefore, the protrusion 77, the recess 78, and the pair of guiding members 79 of the embodiment are separately formed. Thus, the function of guiding the shutter 74 and the function of locking the shutter 74 are implemented by different members. Accordingly, the force along the outer peripheral direction of the cover 72 is favorably transmitted to the shutters 74 and 84. Thus, the opening and closing operation of the shutters 74 and 84 can be favorably performed.

5. Advantage of Toner Bottle of the Embodiment

As described above, in the toner bottle 70 of the embodiment, the lock mechanism 76 and the pair of guiding members 79 are separately formed. As shown in FIG. 6 to FIG. 9, at least the protrusion 77, the recess 78, and the supply port 73 are disposed along the virtual curve VC between the pair of guiding members 79. Thus, the shutter 74 is not fixed and guided by the same member. Thus, the stability of the opening and closing operation of the shutter 74 can be secured. Accordingly, the toner leakage from the supply port 73 can be effectively prevented when the toner bottle 70 is exchanged, conveyed, or subjected to the like operations.

6. Modification

The present invention is not limited to the embodiments described above, and can be modified in various ways.

(1) In the embodiment, the protrusion 77 is attached to the shutter 74 and the shutter 74 and the protrusion 77 are separately formed. However, the configuration is not limited to this. For example, the shutter 74 and the protrusion 77 may be integrally formed as a single member. Specifically, the protrusion 77 only needs to be provided to the shutter 74.

(2) In the exchange procedure of the toner bottle 70 in the embodiment, the toner bottle 70 rotationally moves relative to the sub-hopper 80. However, the configuration is not limited to this. For example, the sub-hopper 80 may rotationally move relative to the toner bottle 70, or both the toner bottle 70 and the sub-hopper 80 may rotationally move. Specifically, the toner bottle 70 rotationally moves relative to the sub-hopper 80.

(3) In the exchange procedure of the toner bottle 70 in the embodiment, the cover 72 rotationally moves relative to the shutter 74. However the configuration is not limited to this. For example, the shutter 74 may rotationally move relative to the cover 72, or both the cover 72 and the shutter 74 may rotationally move. Specifically, the cover 72 rotationally moves relative to the shutter 74.

In the embodiment of the present invention, a lock mechanism and a pair of guiding members are separately formed. A protrusion, a recess, and a first supply port are disposed along a virtual curve between the pair of guiding members. Thus, a first shutter is not fixed and guided by the same member. Accordingly, the stability of the opening and closing operation of the first shutter can be secured. Accordingly, the toner leakage from the first supply port can be effectively prevented when a toner bottle is exchanged.

In the embodiment of the present invention, the first shutter can prevent the toner leakage by only partially covering a main body in an outer peripheral direction. Thus, the manufacturing cost of the first shutter can be reduced.

In the embodiment of the present invention, when the first shutter is fixed by the lock mechanism, a fix end of the protrusion is at a position opposite to the first supply port with respect to the recess. Thus, when the first shutter is fixed by the lock mechanism, the toner leakage from the first supply port can be effectively prevented.

In the embodiment of the present invention, when the first supply port and a second supply port are in an opened state, a seal unit covers a contact portion between the first shutter and a stopper. Thus, the toner supplied from the toner bottle can be prevented from entering a gap around the contact portion.

In the embodiment of the present invention, an end portion of the seal unit can be prevented from being turned by friction force from the first shutter. Also, in the embodiment of the present invention, the end portion of the seal unit can be prevented from being turned by friction force from the stopper.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A toner bottle capable of storing toner in a main body, comprising:

a first shutter configured to cover a first supply port formed in an outer peripheral surface of the main body, the first shutter being movable in an outer peripheral direction along the outer peripheral surface of the main body;

a pair of guiding members respectively formed on both ends of the first shutter, and configured to guide the first shutter in the outer peripheral direction; and a lock mechanism configured to fix the first shutter to achieve a closed state of the first supply port, wherein the lock mechanism comprises a protrusion provided to the first shutter, and the protrusion is capable of engaging with a recess formed in the outer peripheral surface, wherein the recess is not formed in the pair of guiding members, wherein fixing by the lock mechanism is released when the protrusion is disengaged from the recess, and wherein the protrusion, the recess, and the first supply port are provided between the pair of guiding members and are disposed along a virtual line which extends in a circumferential direction of the main body between the pair of guiding members.

2. The toner bottle according to claim 1, wherein the main body has a cylindrical shape.

3. The toner bottle according to claim 1, wherein a length of the first shutter along the outer peripheral direction of the main body is shorter than an outer peripheral length of the main body.

4. The toner bottle according to claim 1, wherein, when the first shutter is fixed by the lock mechanism, a fix end of the protrusion is at a position opposite to the first supply port with respect to the recess.

5. The toner bottle according to claim 4, wherein the protrusion is provided to the first shutter in a cantilever manner.

6. A supply unit configured to supply toner to a developing unit, comprising:

the toner bottle according to claim 1; and a sub-hopper configured to temporarily store the toner supplied from the toner bottle, and supply the toner to the developing unit, wherein the sub-hopper comprises:

a supporter configured to support the toner bottle;

a storage unit configured to store the toner supplied from the toner bottle supported by the supporter through a second supply port; and a second shutter configured to cover the second supply port formed in the storage unit, and wherein as the toner bottle supported by the supporter rotationally moves relative to the sub-hopper, the first and the second supply ports transition to an opened state, and a supply path for the toner through the first and the second supply ports is formed.

7. The supply unit according to claim 6, further comprising a seal unit provided on the main body in such a manner as to surround the first supply port, wherein, when the toner bottle is supported by the supporter, the first shutter is stopped at a stopper provided in an upper portion of the storage unit, and wherein, when the first and the second supply ports are in the opened state, the seal unit covers a contact portion between the first shutter and the stopper.

8. The supply unit according to claim 7, wherein a notch that has a shape corresponding to the recess and exposes the recess is formed in the seal unit.

9. The supply unit according to claim 7, wherein around the contact portion, the first shutter has a larger thickness at a portion farther from the contact portion in the outer peripheral direction of the main body.

10. The supply unit according to claim 7, wherein around the contact portion, the stopper has a larger thickness at a portion farther from the contact portion in a radial direction of the main body.

11. The supply unit according to claim 6, wherein the sub-hopper further comprises a biasing member configured to bias the protrusion toward the main body.

12. An image forming apparatus comprising:

the supply unit according to claim 6;

an image carrier; and the developing unit configured to develop an electrostatic latent image on the image carrier.

* * * * *